US006668872B1

(12) United States Patent
Williams et al.

(10) Patent No.: US 6,668,872 B1
(45) Date of Patent: Dec. 30, 2003

(54) FORM TIE BREAKER TOOL

(76) Inventors: Chad H. Williams, 85 PCR 920, Perryville, MO (US) 63775; David D. Lawrence, 425 Outer Circle Dr., Perryville, MO (US) 63775

( * ) Notice: Subject to any disclaimer, the term of this patent is extended or adjusted under 35 U.S.C. 154(b) by 0 days.

(21) Appl. No.: 10/196,587

(22) Filed: Jul. 15, 2002

(51) Int. Cl.[7] ..... B21F 9/00
(52) U.S. Cl. ..... 140/123; 254/131
(58) Field of Search ..... 140/123, 123.5, 140/149; 254/131

(56) References Cited

U.S. PATENT DOCUMENTS

| | | | | | |
|---|---|---|---|---|---|
| 1,737,084 | A | * | 11/1929 | Hilstad | 72/705 |
| 2,556,343 | A | * | 6/1951 | Shearer | 254/131 |
| 2,608,219 | A | * | 8/1952 | McDaniel | 140/149 |
| 3,546,919 | A | * | 12/1970 | Fial | 140/123 |
| 3,680,835 | A | * | 8/1972 | Rose | 254/131 |
| 4,127,971 | A | | 12/1978 | Rojo, Jr. | |
| 4,178,343 | A | | 12/1979 | Rojo, Jr. | |
| 4,473,209 | A | | 9/1984 | Gallis et al. | |
| 4,483,402 | A | | 11/1984 | Vonhoff, Jr. | |
| 4,952,098 | A | | 8/1990 | Grayson et al. | |
| 5,827,589 | A | | 10/1998 | Autterson | |
| 6,302,157 | B1 | | 10/2001 | Deschenes et al. | |
| 6,336,773 | B1 | | 1/2002 | Anderson et al. | |

* cited by examiner

*Primary Examiner*—Lowell A. Larson
(74) *Attorney, Agent, or Firm*—Armstrong Teasdale LLP

(57) ABSTRACT

Form tie breaking tools are disclosed which include first members, second members and third members. Each member includes a first end and a second end. In particular embodiments, the second member is attached to the first member at either of the second end or between first and second ends of the first member. The third member is attached to the remaining of the second end or between the first and second ends of the first member. Second and third members are attached to the first member approximately parallel to one another. Each third member first end has a form tie engaging member attached. Each form tie engaging member includes a first end and a second end and the form tie engaging member is substantially perpendicularly attached to the third member.

22 Claims, 7 Drawing Sheets

FORM TIE BREAKER TOOL

BACKGROUND OF THE INVENTION

This invention relates generally to construction of concrete structures, and more specifically to, removal of forms from completed concrete structures.

Use of forms for construction of concrete walls and other structures is well known. Forms, typically made from steel, aluminum or another metal, are placed in a position for the construction of the wall or structure. Once properly placed, concrete is poured in from above, typically between opposing sets of forms. To hold the opposing form sets in position for the pouring of the concrete, form ties are run between the sets of forms, in multiple places, to help secure the form sets in a position for concrete pouring.

After the concrete is poured and solidified, the forms must be removed, typically for use in another area of concrete construction. However, the form ties run between the forms sets as described above, and therefore are partially embedded in the new concrete. Once the forms are removed, the ties are left behind and protruding from the concrete walls. In most poured concrete construction it is desirable to have these protruding form ties removed. At least one removal method involves breaking the form ties. The form ties are constructed from a wire like material, for example, steel or aluminum, and have a cross-section. Known methods for breaking these ties include using a wire cutter, or twisting the form ties with a tool such as a large screwdriver or hammer. However, such methods are difficult to practice.

BRIEF SUMMARY OF THE INVENTION

In one aspect, a form tie breaking tool is provided. The tool comprises a first member having a first end, a second end, and a length therebetween. The tool further comprises a second member having a first end and a second end, the second end of the second member being attached to the first member. The tool also comprises a third member having a first end and a second end, the second end of the third member is attached to the first member approximately parallel to the second member. The tool also comprises a form tie engaging member which has a first end and a second end. The form tie engaging member is attached to the first end of the third member substantially perpendicular to the third member.

In another aspect, a method of breaking form ties extending from a wall using the above described form tie breaking tool is provided. In addition, the second end of the second member is attached to the second end of the first member and the second end of the third member is attached between the first end and the second end of the first member. The method comprises inserting the form tie engaging member within a loop of a form tie, placing the first end of the second member against the wall, and applying a force utilizing the first end of first member until the form tie breaks free from the wall.

In still another aspect, an alternative method of breaking form ties extending from a wall using a form tie breaking tool as described above, is provided. In addition, the second end of the third member is attached to the second end of the first member and the second end of the second member is attached between the first end and the second end of the first member. The method comprises inserting the form tie engaging member within a loop of a form tie, placing the first end of the second member against the wall, and applying a force utilizing the first end of first member toward the wall until the form tic breaks free from the wall.

DETAILED DESCRIPTION OF THE INVENTION

Figure 1:
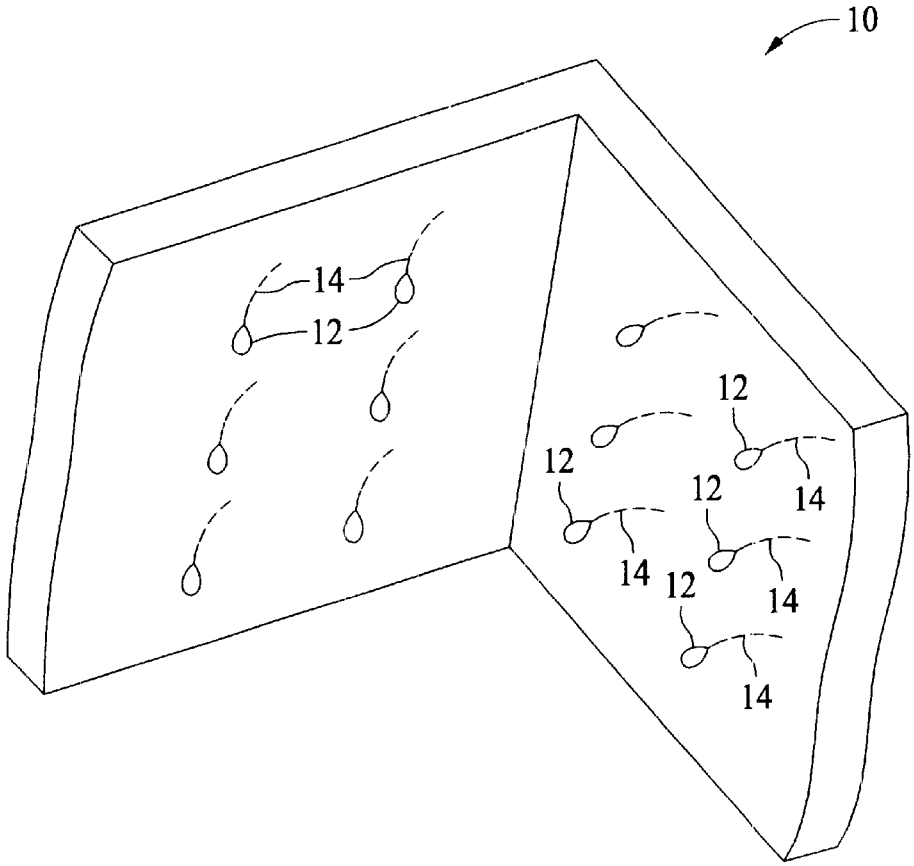
FIG. 1 is a diagram of a concrete wall showing loops of form ties.

FIG. 1 is a diagram of a portion of a completed wall 10 showing loops 12 in form ties 14. In one embodiment, wall 10 is a concrete wall. Alternatively, wall 10 is any type of wall formed by pouring a liquid or semi-liquid into a space defined by utilization of forms that results in a solid wall. For illustrative purposes, forms are not shown in the Figure. However, to remove form ties 14 from a completed wall or structure, loops 12 of form ties 14 are "snapped" or broken off wall 10.

Figure 2:
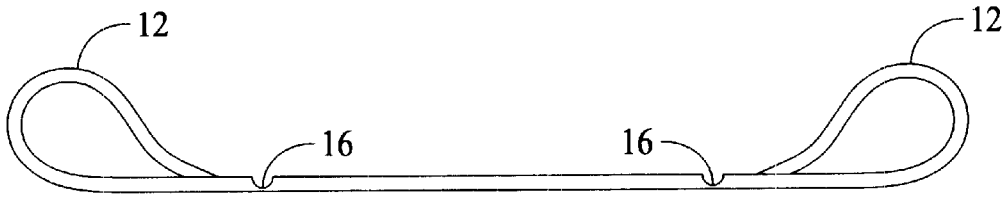
FIG. 2 is a diagram illustrating the construction of a form tie.

FIG. 2 illustrates the construction of a form tie 14. Form tie 14 includes a loop 12 at each end. Form tie further includes one or more indentations or scores 16 in the length of form tie 14 which provides a weakened area for breaking off form ties as above described. In one known form tie 14, scores 16 are about one inch from loops 12. The length of form tie 14 between loops is approximately the same as a distance between opposing forms which are utilized to define a space for the concrete wall as described above. Loops 12 are utilized with pins (not shown) inserted therethrough in order to retain a placement of the forms.

Figure 3:
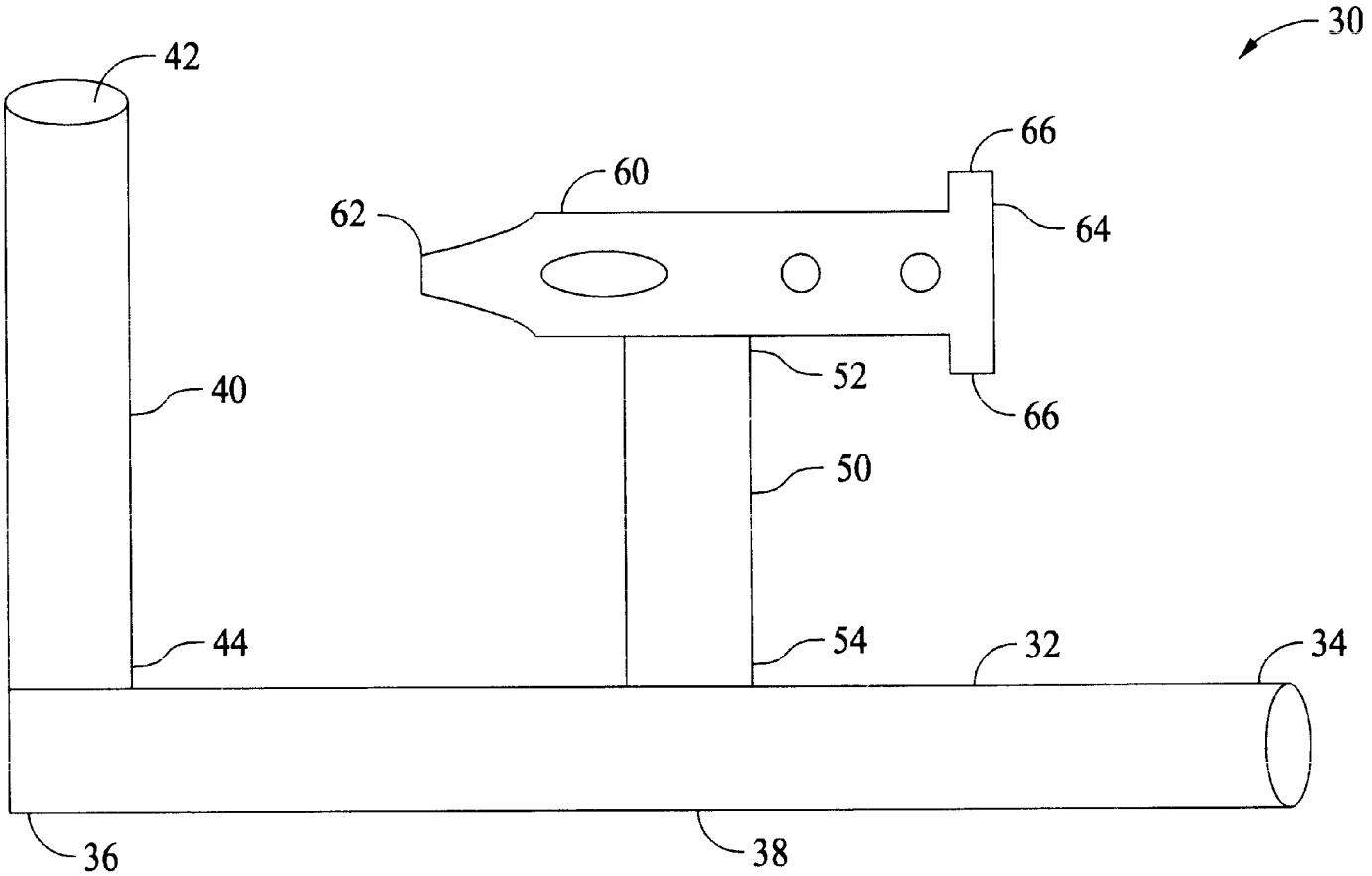
FIG. 3 is one embodiment of a form tie breaking tool.

FIG. 3 illustrates one embodiment of a form tie breaking tool 30. Tool 30 includes a first member 32 having a first end 34, a second end 36, and a length 38 therebetween. First end 34, in the embodiment illustrated, forms a handle. Tool 30 also includes a second member 40 which has a first end 42 and a second end 44. In the embodiment shown, second end 44 is attached to second end 36 of first member 38. Further, tool 30 includes a third member 50 having a first end 52 and a second end 54 where second end 54 is attached to first member 32 between first end 34 and second end 36 of first member 32. Second member 40 and third member 50 are, in one embodiment, attached approximately parallel to one another. Tool 30 also includes a form tie engaging member 60 which has a narrowed first end 62, with a reduced cross-section, and a second end 64 having a pair of projecting portions 66. Projecting portions 66 increase a cross-section of second end 64 of form tie engaging member 60. Form tie engaging member 60 is attached to first end 52 of third member 50 roughly between first end 62 and second end 64, and is attached at an approximate right angle to third member 50.

In one embodiment, tie breaking tool 30, and specifically first member 32, second member 40, and third member 50 are constructed from a reinforcing material which is commonly referred to as re-bar. In the embodiment illustrated, tie engaging member 60 is a form clip, as is known by those who work with forms, and members 32, 40, 50, and 60 are welded to one another. In alternative embodiments, tool 30 is cast or formed from one of iron, steel, a hardened metal, and aluminum.

In an exemplary embodiment, first member 32 of tool 30 is about 20 inches long, second member 40 is about 6 inches long, and third member 50 is about 4 inches long. Form tie engaging member 60 is about 4 inches long. In alternative embodiments, of tool 30, second member 40 is about 30% of a length of first member 32, and third member 50 is about 20% of the length of first member 32.

Figure 4:
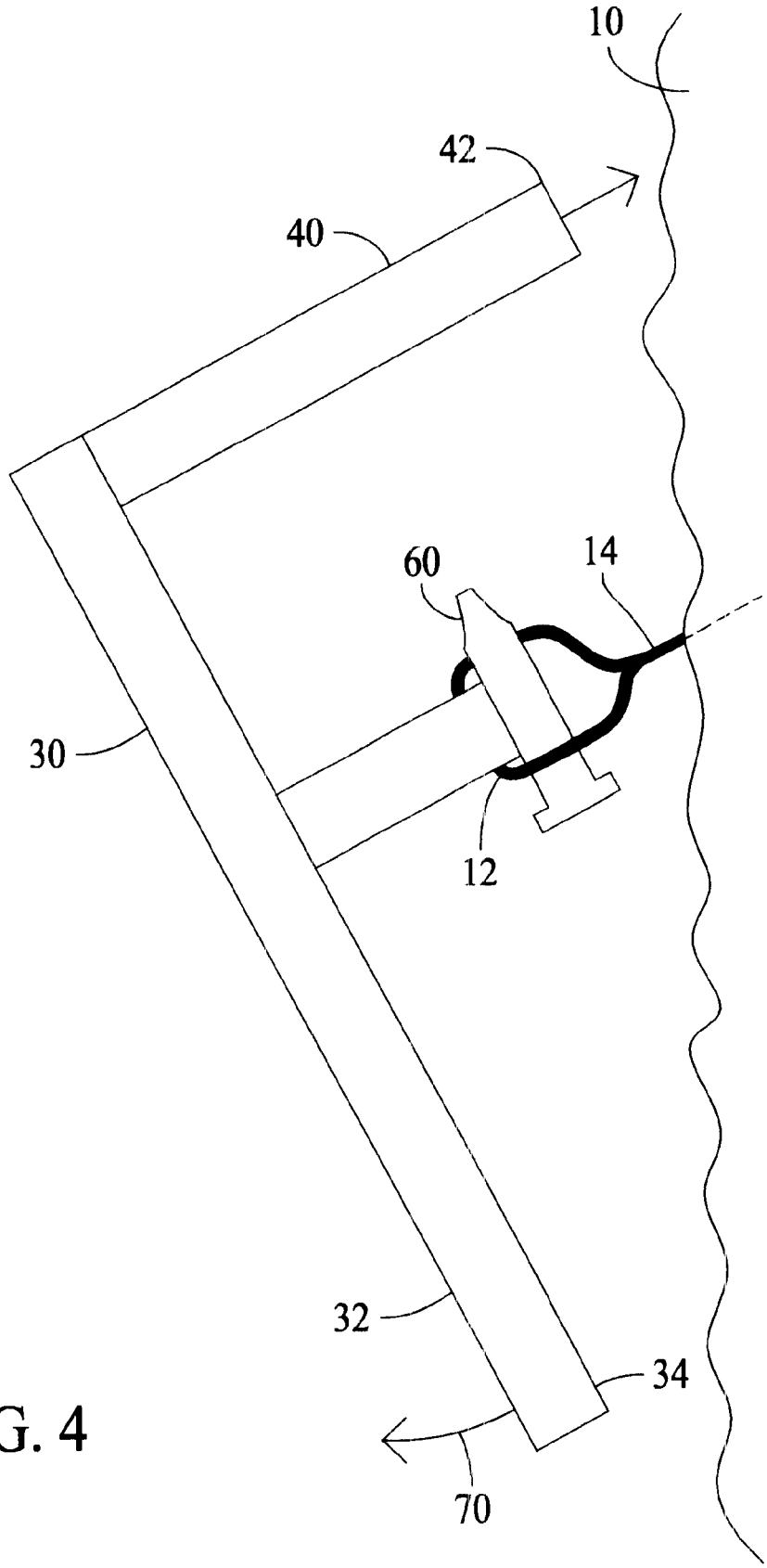
FIG. 4 illustrates the tool of FIG. 3 breaking a form tie.

In one embodiment, tool 30 is utilized to break form ties in an open area of a wall. Referring to FIG. 4, a method for breaking form ties is illustrated as member 60 is inserted into a loop 12 of form tie 14. A user presses first end 42 of second member 40 against wall 10 and applies a force 70 in an opposite direction from wall 10 utilizing first end 34 of first member 32 until loop 12 and a portion of form tie 14 breaks at score 16, thus freeing that portion from wall 10. Alternatively, a form tie 14 may be broken by twisting tool 30, either clockwise or counterclockwise, when tie breaking member 60 is engaged within a loop 12 of a form tie 14 utilizing first end 34 of first member 32 in a direction parallel to that of wall 10. The twisting motion causes form tie 14 to break at score 16.

In still another alternative method, score 16 may be slightly embedded within wall 10. In such a case, form tie 14 may be broken at score 16 by twisting tool 30 when tie breaking member 60 is engaged within a loop 12 of a form tie 14 utilizing first end 34 of first member 32 in a direction parallel to that of wall 10. Once form tie 14 is broken, the user then applies a force 70 in an opposite direction from wall 10 utilizing first end 34 of first member 32 until a portion of form tie 14 within wall 10 up to and including score 16 is extracted from wall 10.

Figure 5:
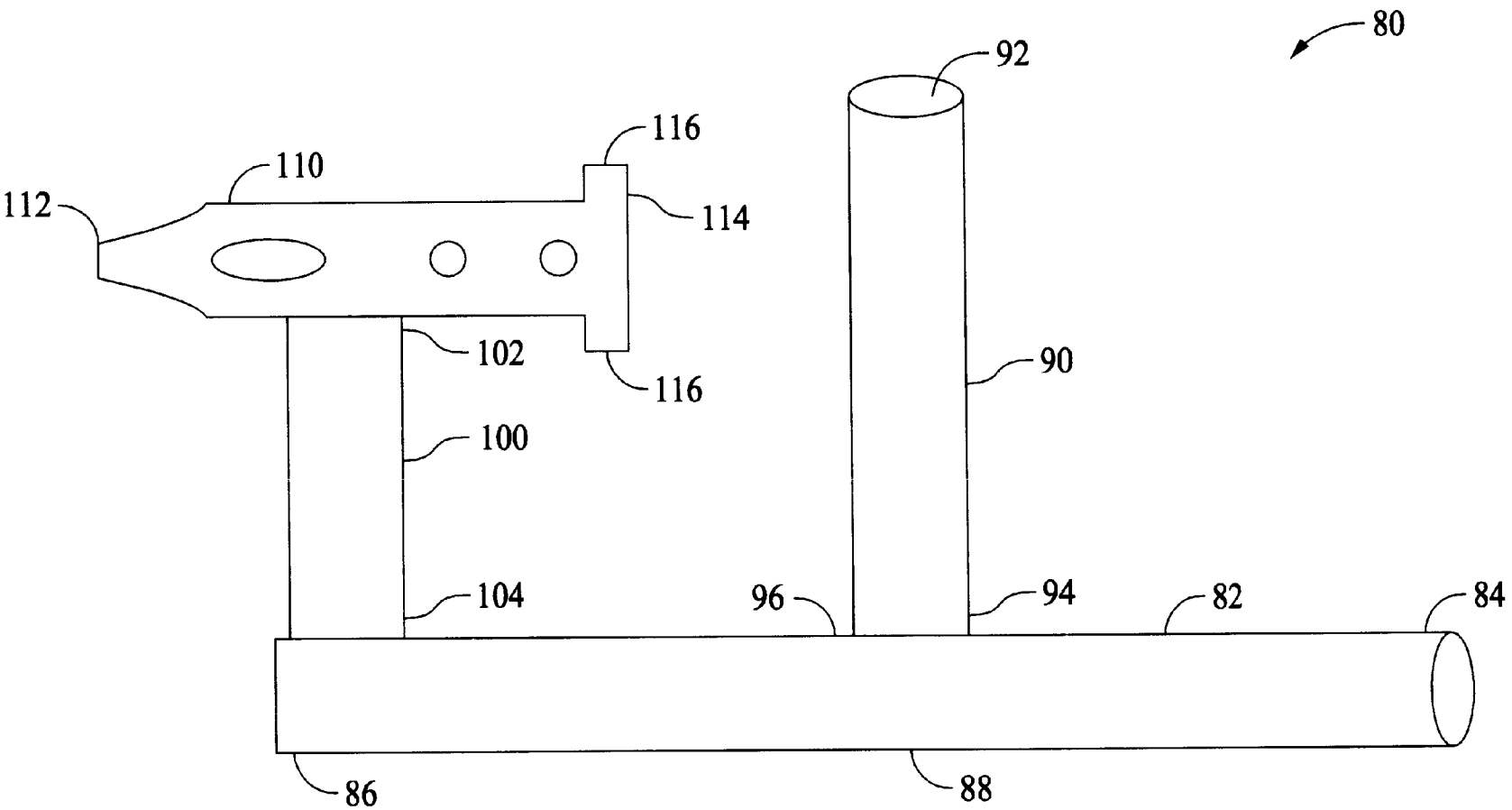
FIG. 5 is a second embodiment of a form tie breaking tool.

FIG. 5 illustrates an alternative embodiment of a form tie breaking tool 80. Tool 80 includes a first member 82 having a first end 84, a second end 86, and a length 88 therebetween. First end 84, in the embodiment illustrated, forms a handle. Tool 80 also includes a second member 90 which has a first end 92 and a second end 94. In the embodiment shown, second end 94 of second member 90 is attached roughly between first end 84 and second end 86 of first member 82. Further, tool 80 includes a third member 100 having a first end 102 and a second end 104. Second end 104 is attached to second end 86 of first member 82. Second member 90 and third member 100 are, in one embodiment, attached to first member 82 approximately parallel to one another. Tool 80 also includes a form tie engaging member 110 which has a narrowed first end 112, with a reduced cross-section, and a second end 114 having a pair of projecting portions 116. Projecting portions 116 increase a cross-section of second end 114 of form tie engaging member 110. Form tie engaging member 110 is attached to first end 102 of third member 100 roughly between narrowed first end 112 and second end 114, and is attached at an approximate right angle to third member 100.

Tool 80 and specifically first member 82, second member 90, and third member 100 are constructed from re-bar. In the embodiment illustrated, tie engaging member 110 is a form clip, as is known by those who work with forms, and members 82, 90, 100, and 110 are welded to one another. In alternative embodiments, tool 80 is cast or formed from one of iron, steel, a hardened metal, and aluminum.

In an exemplary embodiment, first member 82 of tool 80 is about 20 inches long, second member 90 is about 6 inches long, and third member 100 is about 4 inches long. Form tie engaging member 110 is about 4 inches long. In alternative embodiments, tool 80 second member 90 is about 30% of a length of first member 82 and third member 100 is about 20% of the length of first member 82.

Figure 6:
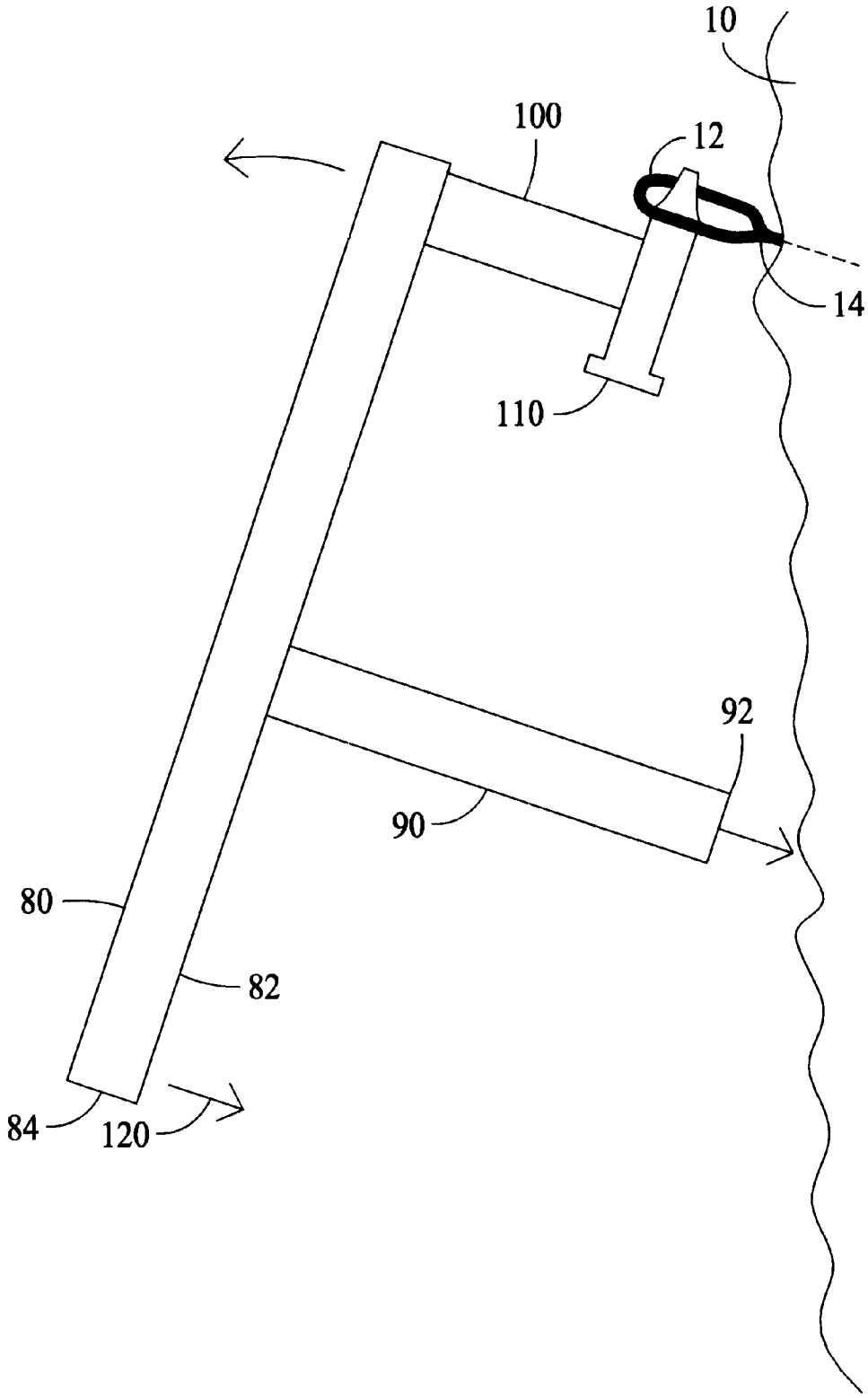
FIG. 6 illustrates the tool of FIG. 5 breaking a form tie.

Tool 80 is utilized for breaking form ties 14 at or near corners or other discontinuities in concrete or other walls, where twisting tool 30 or 80 is impractical. Referring to FIG. 6, a method for breaking form ties 14 is illustrated. Tie breaking member 110 is utilized to engage loop 12 of form tie 14 and a force 120 is applied to first end 84 of first member 82 such that second member 90, at first end 92, becomes a fulcrum, enabling tool 80 to break form tie 14 at score 16 as an opposite force is applied to form tie 14, and score 16, from form tie engaging member 110.

Figure 7:
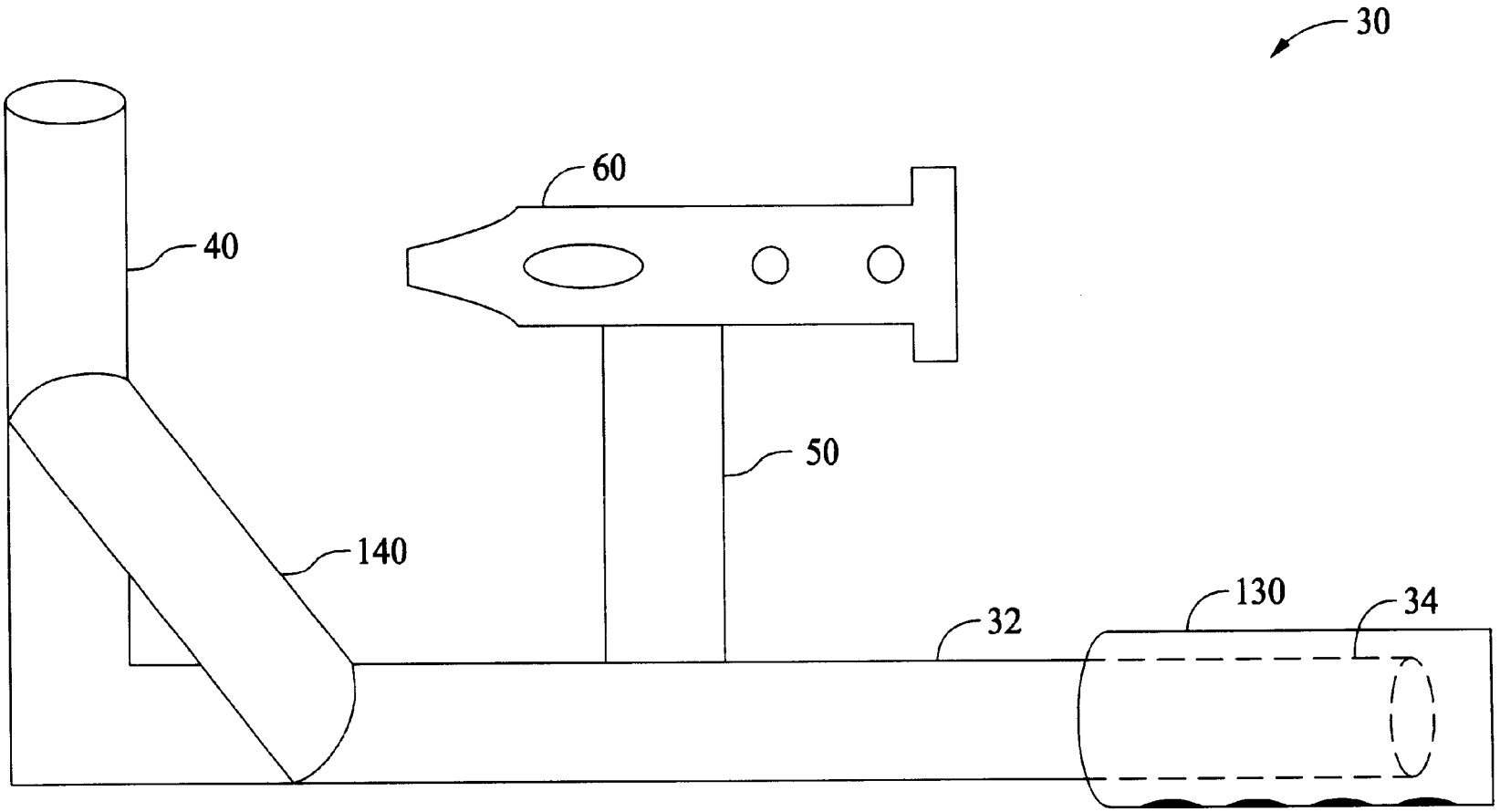
FIG. 7 is an embodiment of the form tie breaking tool of FIG. 3 including a cushioned handle and a strengthening member.

Referring to FIG. 7, an alternative embodiment of tool 30 is illustrated. Tool 30 includes the components as described above with respect to FIG. 3, and additionally first end 34 of first member 32 is covered with a cushioning material 130, for example, a coated foam rubber, to make tool 30 more ergonomic. A strengthening member 140 is attached to first member 32 and extends at an angle to second member 40. Strengthening member 140 can be welded to tool 30 or cast in one piece as part of tool 30 as described above. Of course, cushioning material 130 and strengthening member 140 can be utilized with tool 80 (shown in FIG. 4).

Figure 8:
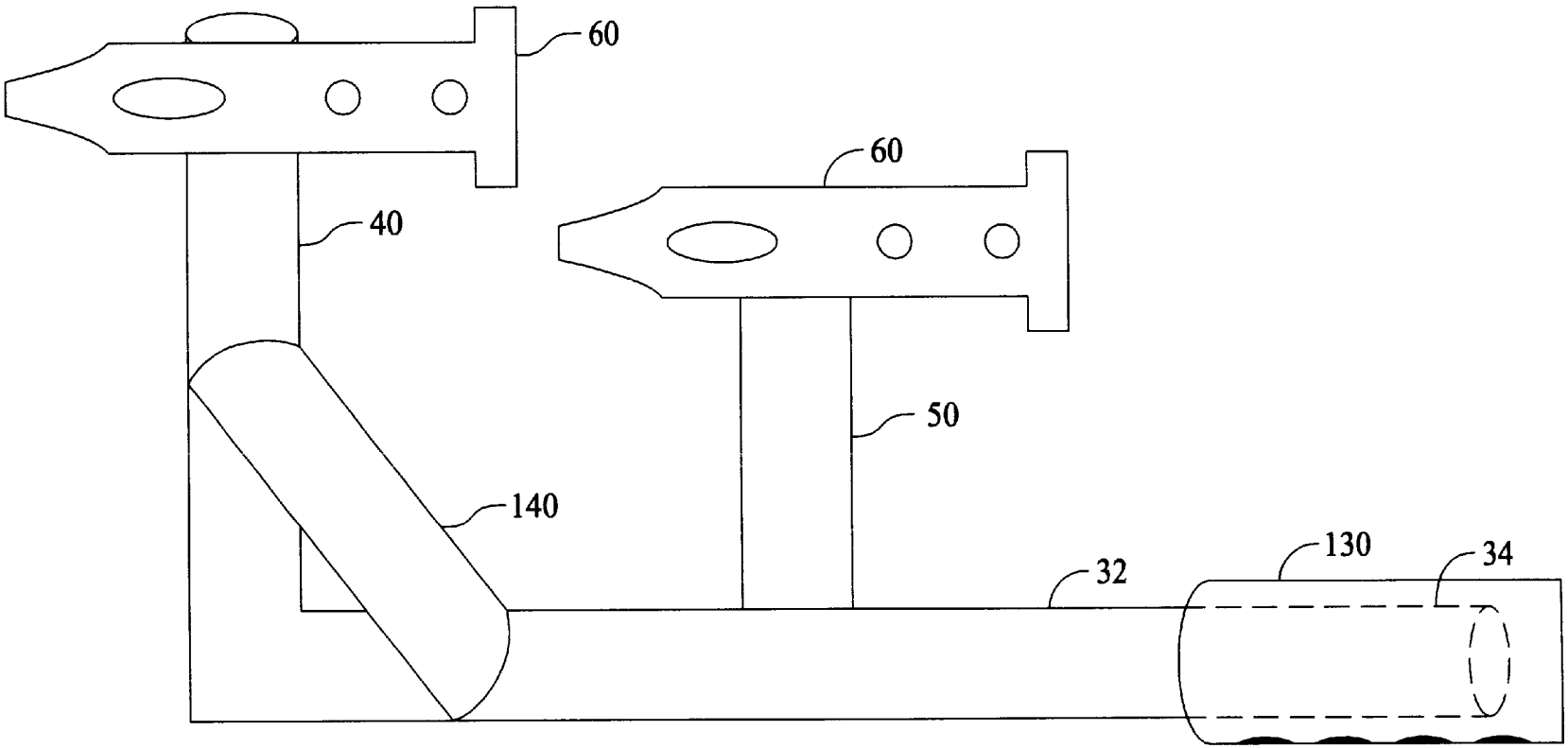
FIG. 8 is an embodiment of the form tie breaking tool of FIG. 7 including a second form tie engaging member.

Referring to FIG. 8, yet another alternative embodiment of tool 30 is illustrated. Tool 30 includes the components as described above with respect to FIGS. 3 and 7, and additionally a second form tie engaging member 60 is attached to second member 40. Of course, a second form tie engaging member 60 can be utilized with tool 80 (shown in FIG. 4).

While the invention has been described in terms of various specific embodiments, those skilled in the art will recognize that the invention can be practiced with modification within the spirit and scope of the claims.

What is claimed is:

1. A form tie breaking tool comprising:

a first member comprising a first end, a second end, and a length therebetween;

a second member comprising a first end and a second end, said second end of said second member attached to said first member;

a third member comprising a first end and a second end, said second end of said third member attached to said first member and approximately parallel to said second member; and a form tie engaging member comprising a first end and a second end, said form tie engaging member attached to said first end of said third member substantially perpendicular to said third member.

2. A tie breaking tool according to claim 1 wherein said second end of said second member is attached to said second end of said first member and said second end of said third member is attached between said first end and said second end of said first member.

3. A tie breaking tool according to claim 1 wherein said second end of said third member is attached to said second end of said first member and said second end of said second member is attached between said first end and said second end of said first member.

4. A tie breaking tool according to claim 1 wherein said first member, said second member, and said third member are constructed from re-bar, said form tie engaging member is constructed from a form clip, and said members are welded to one another.

5. A tie breaking tool according to claim 1 wherein said first member, said second member, said third member, and said form tie engaging member are welded to one another.

6. A tie breaking tool according to claim 1 wherein said tool is cast from at least one of iron, steel, a hardened metal, and aluminum.

7. A tie breaking tool according to claim 1 wherein said first end of said first member comprises a handle.

8. A tie breaking tool according to claim 7 wherein said handle is covered with a cushioning material.

9. A tie breaking tool according to claim 1 wherein said second member is longer than said third member and said first member is longer than said second member.

10. A tie breaking tool according to claim 1 wherein said second member is about 30% of a length of said first member and said third member is about 20% of the length of said first member.

11. A tie breaking tool according to claim 1 wherein said first end of said form tie engaging member has a reduced cross-section and said second end of said form tie engaging member has an increased cross-section.

12. A tie breaking tool according to claim 1 further comprising a member attached to said first member and extending at an angle to said second member.

13. A tie breaking tool according to claim 1 further comprising a second form tie engaging member, said second form tie engaging member attached to said first end of said second member substantially perpendicular to said second member.

14. A method of breaking form ties extending from a wall using a form tie breaking tool, the form tie breaking tool having a first member with a first end, a second end, and a length therebetween, a second member with a first end and a second end, the second end of the second member being attached to the second end of the first member, a third member having a first end and a second end, the second end of the third member being attached between the first end and the second end of the first member and approximately parallel to the second member, and a form tie engaging member having a first end and a second end, the form tie engaging member attached to the first end of the third member, said method comprising:

inserting the form tie engaging member within a loop of a form tie;

placing the first end of the second member against the wall; and applying a force utilizing the first end of first member until the form tie breaks free from the wall.

15. A method according to claim 14 wherein applying a force comprises applying a force in a direction opposite from the wall utilizing the first end of the first member until the form tie breaks free from the wall.

16. A method according to claim 14 wherein applying a force comprises applying a force in a direction parallel to the wall utilizing the first end of the first member, twisting the form tie, until the form tie breaks free from the wall.

17. A method according to claim 14 wherein the form tie engaging member first end has a reduced cross-section, and wherein inserting the form tie engaging member within a loop comprises inserting the first end of the form tie engaging member into the loop until at least a portion of the third member engages the loop.

18. A method according to claim 14 wherein the form tie engaging member second end has a pair of protrusions, and wherein inserting the form tie engaging member within a loop comprises:

inserting the second end of the form tie engaging member into the loop; and engaging the loop with the pair of protrusions.

19. A method according to claim 14 wherein applying a force comprises:

applying a force in a direction parallel to the wall utilizing the first end of the first member, twisting the form tie, until the form tie breaks; and applying a force in a direction opposite from the wall utilizing the first end of the first member until a portion of the form tie is extracted from the wall.

20. A method of breaking form ties extending from a wall using a form tie breaking tool, the form tie breaking tool having a first member having a first end, a second end, and a length therebetween, a second member having a first end and a second end, the second end of the second member being attached between the first end and the second end of the first member, a third member having a first end and a second end, the second end of the third member attached to the second end of the first member and approximately parallel to the second member, and a form tie engaging member having a first end and a second end, the form tie engaging member attached to the first end of the third member, said method comprising:

inserting the form tie engaging member within a loop of a form tie;

placing the first end of the second member against the wall; and applying a force utilizing the first end of first member toward the wall until the form tie breaks free from the wall.

21. A method according to claim 20 wherein the form tie engaging member first end has a reduced cross-section, and wherein inserting the form tie engaging member within a loop comprises inserting the first end of the form tie engaging member into the loop until at least a portion of the third member engages the loop.

22. A method according to claim 20 wherein the form tie engaging member second end has a pair of protrusions, and wherein inserting the form tie engaging member within a loop comprises:

inserting the second end of the form tie engaging member into the loop; and engaging the loop with the pair of protrusions.

* * * * *